US006799599B2

(12) United States Patent
Hoffmann

(10) Patent No.: US 6,799,599 B2
(45) Date of Patent: Oct. 5, 2004

(54) VALVE

(75) Inventor: Alois Hoffmann, Saarbrucken (DE)

(73) Assignee: Hydac Fluidtechnik GmbH, Sulzbach/Saar (DE)

( * ) Notice: Subject to any disclaimer, the term of this patent is extended or adjusted under 35 U.S.C. 154(b) by 73 days.

(21) Appl. No.: 10/344,551

(22) PCT Filed: Aug. 7, 2001

(86) PCT No.: PCT/EP01/09083

§ 371 (c)(1),
(2), (4) Date: Feb. 13, 2003

(87) PCT Pub. No.: WO02/14696

PCT Pub. Date: Feb. 21, 2002

(65) Prior Publication Data

US 2003/0178060 A1 Sep. 25, 2003

(30) Foreign Application Priority Data

Aug. 16, 2000 (DE) ..... 100 39 936

(51) Int. Cl.[7] ..... F15B 11/044

(52) U.S. Cl. ..... 137/115.03; 137/115.09; 137/504

(58) Field of Search ..... 137/115.03, 115.09, 137/504

(56) References Cited

U.S. PATENT DOCUMENTS 4,240,457 A * 12/1980 Riediger ..... 137/115.06
4,921,547 A * 5/1990 Kosarzecki ..... 137/115.09

FOREIGN PATENT DOCUMENTS

| | | |
|---|---|---|
| DE | 1108996 | 6/1961 |
| DE | 19851553 | 9/1999 |
| EP | 0802106 | 10/1997 |
| EP | 0893607 | 1/1999 |

* cited by examiner

*Primary Examiner*—Stephen M. Hepperle
(74) *Attorney, Agent, or Firm*—Roylance, Abrams, Berdo & Goodman L.L.P.

(57) ABSTRACT

The invention relates to a valve that comprises at least one pump connection (10), one tank connection (14) and one consumer connection (18), and a valve piston (22) that is displaced within the valve box (12). Said valve piston separates the pump connection (10) from the tank connection (14) in at least one blocked position and interacts with an energy accumulator (24). A fluid stream that flows between the consumer connection (18) and the tank connection (14) is controlled by means of a control device (26). The control device (26) is configured as a fluid stream control that is integrated in the valve piston (22) and that allows, contrary to known valves which use a diaphragm construction, reduction, by a constant value, of the volume flow to the consumer in a load-independent manner, thereby allowing for a proportional load-independent control.

7 Claims, 2 Drawing Sheets

VALVE

FIELD OF THE INVENTION

The invention relates to a valve having at least one pump connection, one tank connection, and one appliance connection and a valve piston positionable inside the valve housing, which piston separates the pump connection from the tank connection in at least one blocked position and which operates in conjunction with an energy accumulator, a self-adjusting fluid flow being controllable by means of a control device between the appliance connection and the tank connection.

BACKGROUND OF THE INVENTION

Such valves are routinely used in so-called hydraulic load sensing systems or control means and operate there like a piston manometer, directing an unneeded pump feed flow back to the tank. In order to prevent leakages in the appliance circuit from raising the appliance pressure to the performance level of the pump and thereby possibly disabling the load sensing system, the load on the appliance connection to the tank is to be removed. Such load removal is currently effected in a cost-effective manner by use of aperture control means, the aperture preferably being integrated directly into the piston manometer or being used separately in a control unit which is part of the load sensing control mechanism.

A disadvantage of these known solutions with the aperture design feature is the pressure dependence of the volume flow draining to the tank. In the case of appliances whose volume flow is independent of load, proceeds by way of proportional valves, for example, this then results in constant slowing of the appliance with increase in the load pressure, something which has an especially negative effect in the case of appliances with a low volume flow.

SUMMARY OF THE INVENTION

On the basis of this state of the art the invention pursues the object of further improving known valves to the end that such valves will not be characterized by the disadvantages described, especially when employed in so-called load sensing systems. In addition, it is to be possible to reduce the valve cost efficiently and so that the valve occupies little space. The object as thus formulated is attained by means of a valve having the features specified in claim 1. Since, as specified in the descriptive portion of claim 1, the control device consists of a fluid flow controller integrated into the valve piston it is possible, in contrast with known valve solutions, to use the aperture design to reduce the volume flow to the appliance, independently of the load, by a constant value, so that proportional load-independent control is effected. The disadvantages of the state of the art as described, in the form of slowing of the appliance in particular, are thus reliably excluded. The solution with the fluid flow controller claimed for the invention can be cost effectively applied and space-saving installation in the valve itself is possible as a result of integration of the fluid flow controller into the valve box. Since the valve claimed for the invention has only a few structural components, reliability of operation is ensured which benefits the load sensing system as a whole.

Other advantageous embodiments are specified in the dependent claims.

BRIEF DESCRIPTION OF THE DRAWINGS

The valve claimed for the invention is explained in detail in what follows with reference to the drawing, in which, in diagrammatic form and not to scale.

DETAILED DESCRIPTION OF THE INVENTION

Figure 1:
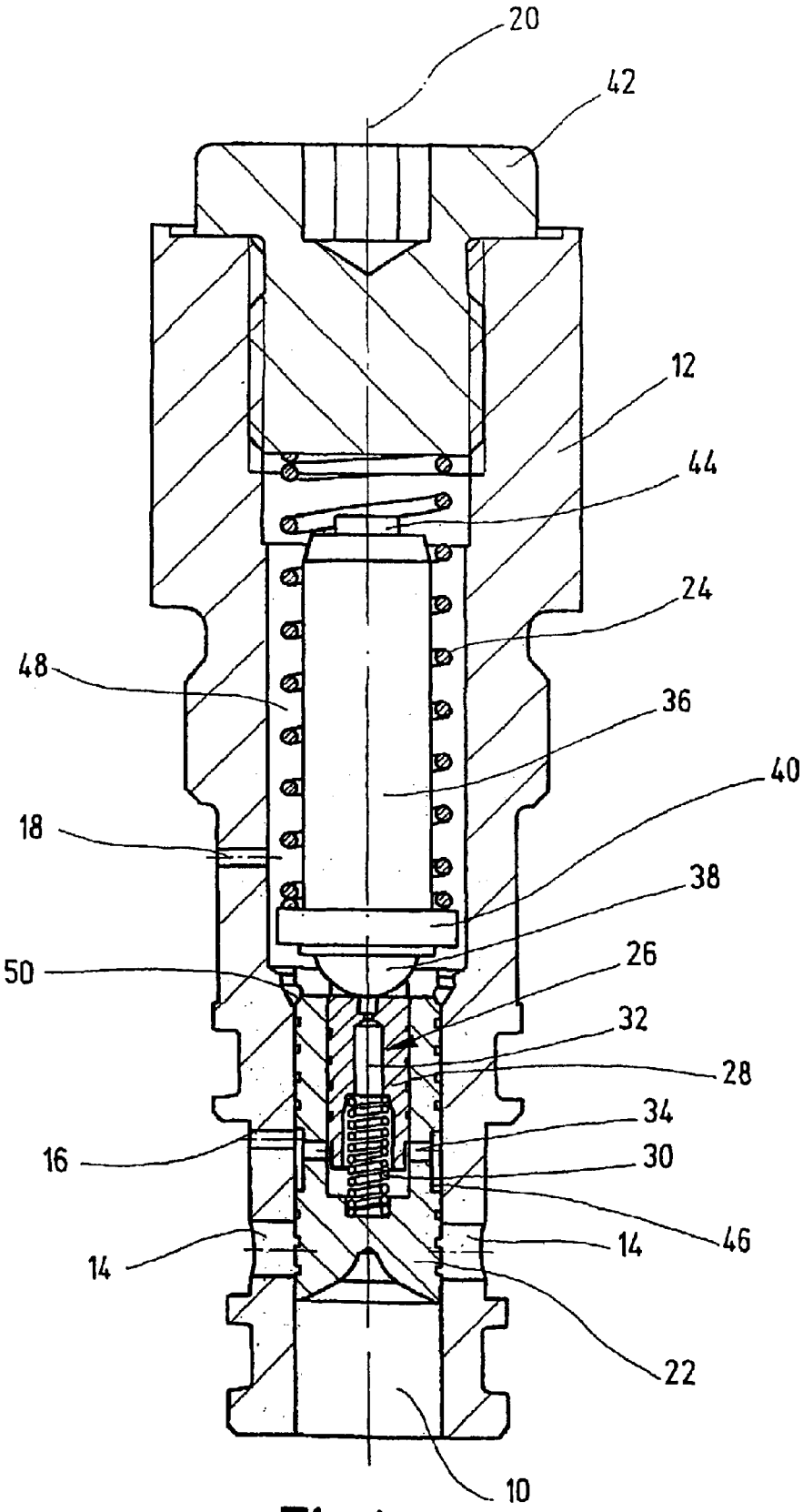
FIG. 1 presents a longitudinal section through the valve claimed for the invention.

The valve shown in longitudinal section in FIG. 1 has a pump connection 10, specifically on the front end of a valve box 12, designed as a screw-in cartridge to be secured in control units or the like for subsequent use. Configuration as a built-in set or the like is also possible. The valve box 12 has at its end facing the pump connection 10 two first tank connections 14 diametrically opposite each other. As viewed in the line of sight to FIG. 1, mounted above them (as shown in the left half of the illustration) is another separate tank connection 16 whose free open cross-section is smaller than the corresponding diameter area of the first tank connections 14. On the other hand, another cross bore which serves as appliance connection 18 has been introduced into the valve box 12. The tank connections 14 and 16 also are in the form of cross bores in the valve box 12. The connections 14, 16, and 18 in question extend more or less transversely to the longitudinal axis 20 of the valve box 12. The pump connection 10, in contrast, is mounted along the longitudinal axis 20 of the valve box 12, on the front side of the latter.

Mounted in the valve box 12 so as to be longitudinally positionable is a valve piston 22 the external circumference of which is provided with pressure relief ducts by conventional means, which accordingly are not described in detail. In one of its blocked positions as shown in FIG. 1 this valve piston in any event separates the pump connection 10 from the tank connection 14. Furthermore, the valve piston 22 operates in conjunction with an energy accumulator 24, it being possible to activate a self-adjusting fluid flow between the appliance connection 18 and the tank connection 14 by means of a control device identified as a whole as 26. The control device 26 in question consists in particular of a fluid flow regulator which is integrated into the valve piston 12 and is explained in greater detail in what follows with respect to its structure and function.

The fluid flow regulator in question has a flow regulating piston 28 which is controlled in the valve piston 22 so as to be longitudinally positionable, the inner circumference of the valve piston 22 encircling the outer circumference of the flow regulating piston 28. The flow regulating piston 28 in turn rests on another energy accumulator 30, the direction of operation of which is opposite that of the first energy accumulator 24. Along the longitudinal axis 20 of the valve box 12, and so in the center, the flow regulating piston 28 has a fluid channel 32, which, at least in one displaced position of the flow regulating piston 28 as shown in FIG. 1, discharges into a fluid channel 34 the valve piston 22 which, again in the displaced position shown in FIG. 1, establishes a fluid-conducting connection with the separate tank connection 16 in the valve box 12. In each displaced position of the valve piston 22 the latter separates the first tank connections 14 from the other separate tank connection 16.

The fluid channel 32 of the flow regulating piston 28 may, on its side facing the appliance connection 18, be sealed by a control piston 36 which is held in the direction of this locking position by way of the first energy accumulator 24. On its end in this direction the fluid channel 32 has a throat and, as shown in FIG. 1, discharges into the open at its end with reduced cross-section. The control piston 36 in question has as contact component a cup 38 which is in the form of a hemisphere and, with its curved frontal engaging surface, is provided for fluid-conducting introduction into the fluid channel 32 of the flow regulating piston 28. In the position illustrated and in every other shifted position the cup 38 leaves the free end of the fluid channel 32 with its reduced cross-section clear for passage of fluid. As is to be seen in the line of sight to FIG. 1, a flange-like enlargement 40 is mounted above the cup 38; the free end of the pressure spring which forms the first energy accumulator 24 rests on this enlargement. The other free end of the pressure spring as energy accumulator 24 is in contact with an end stop 42 which is screwed into the valve box 12 on the end opposite the pump connection 10 and is secured in this manner. On its end facing the end stop 42 the control piston 36 has a stop face 44 which maintains axial spacing from the end stop as seen in the longitudinal direction of the longitudinal axis 20 also when the valve is in the usual operating state.

As a result of the action of the energy accumulator 24 and of the control piston 36, the flow regulating piston 28 is held down in the direction of a lower position, as viewed in the line of sight toward FIG. 1. Acting against the direction of action in question, within the integrated system represented by flow regulating piston 28 and valve piston 22, there is another energy accumulator 30 in the form of a pressure accumulator one lower end of which rests on the valve piston 22 and the other end of which rests on the flow regulating piston 28 in such a way that it is introduced into the fluid channel 32 of the flow regulating piston 28. For the purpose of such introduction the diameter of the fluid channel 32 of the flow regulating piston 28 is enlarged in the direction of its lower free end.

The flow regulating piston 28 is guided in the interior of the valve piston 22, which for this purpose has a cylindrical interior recess; when a fluid connection has been established among the separate tank connection 16, the fluid channel 34, and the fluid channel 32, the upper front ends of valve piston 22 and flow regulating piston 28 come together while more or less level in one plane which extends transversely to the longitudinal axis 20. In the configuration in question the lower free end of the flow regulating piston 28 is spaced an axial distance from the lower receiving end of the valve piston 22 such that the latter comes to rest flush against the upper edge of the part of the fluid channel 34 which faces the interior of the valve piston 22. The side of the fluid channel 34 facing away from the valve piston 22 widens into an annular recess 46 the upper edge of which fits snugly, in the circuit diagram shown in FIG. 1, against the separate tank connection 16. In addition, the lower free end of the other energy accumulator 30 in the form of the pressure spring is received into an interior recess on the bottom side of the valve piston 22 and in this way supported in this position. The appliance connection 18 discharges into a valve space 48 of the valve box 12 through which extend the control piston 36 and the first energy accumulator 24. In addition, the valve box 12 has for the valve piston 22, on its side facing the valve space 48, a stop surface 50, in the form of a retaining ring (not shown), for example. As a result, the valve piston 22 may be freely positioned downward in the line of sight to FIG. 1 of the pump connection 10, while the positioning path is limited in the opposite direction.

As a function of the pressure loads on the appliance connection 18, also designated as load connection, the cup 38 as closing component is held back against the action of the energy accumulators 24 and 30 and/or the flow regulating piston 28 is positioned downward in the valve piston 22 as viewed in the line of sight to FIG. 1, so that fluid channel 32 is fully released. The configuration in question may be adjusted so that the volume flow to the appliance may be reduced free of load by a constant value so that proportional load-independent control is also possible if leaks occur.

Figure 2:
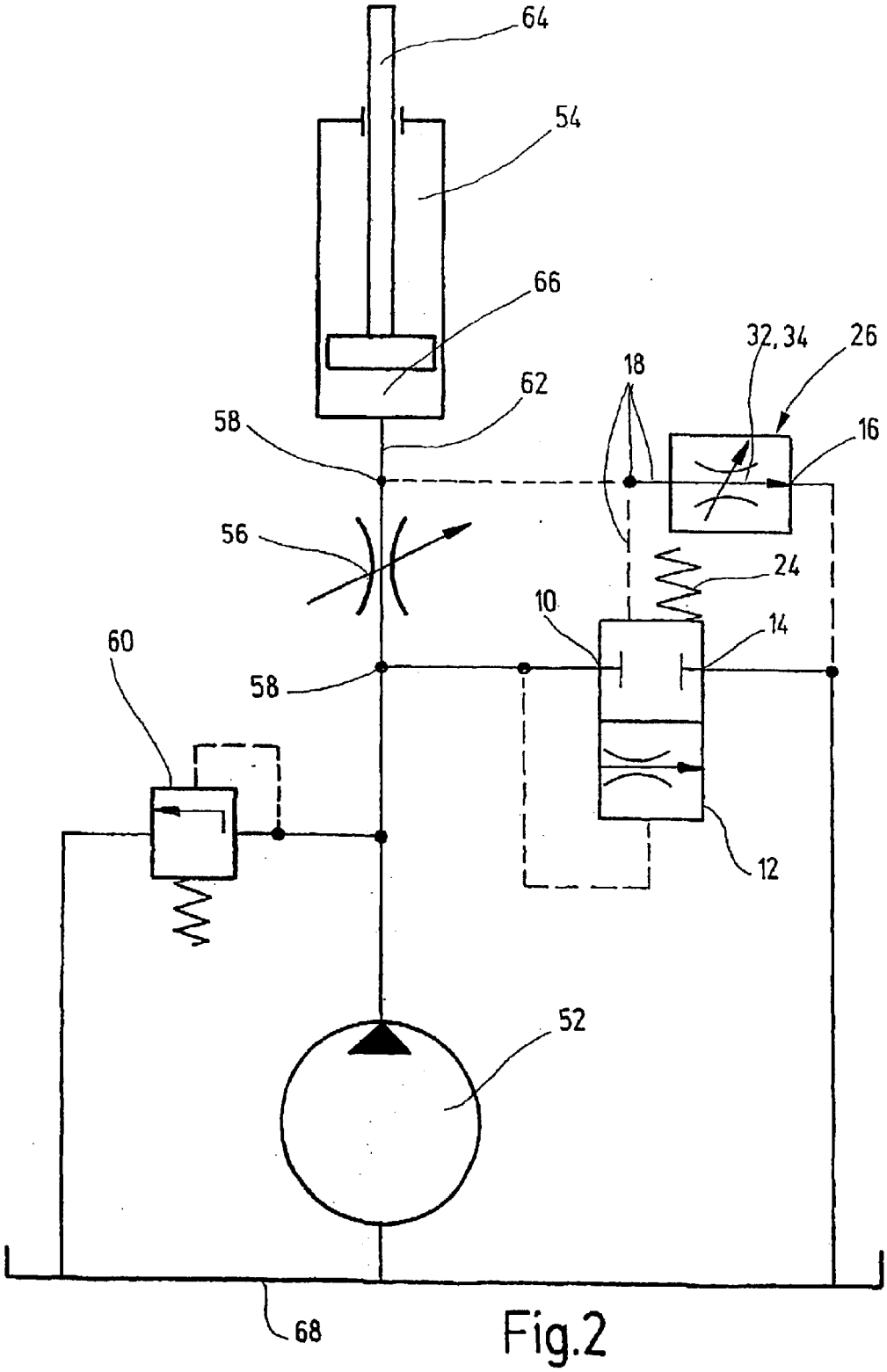
FIG. 2 in the form of a circuit diagram, illustrates use of the valve as shown in FIG. 1 in the case of a load sensing system with an operating cylinder as hydraulic appliance.

The block diagram presented in FIG. 2 shows how proportional load-independent control may be effected for this purpose. This figure illustrates a basic circuit concept of a so-called load sensing system, a fixed-displacement pump 52 being employed in the embodiment shown in FIG. 2. Variable-displacement pumps (not shown) may be appropriately used rather than the fixed-displacement pumps in question. The purpose of the load sensing referred to is achievement of optimized energy utilization, the load pressure returned to a regulating element in the form of the valve being employed to adjust the output provided hydraulically by way of the fixed-displacement pump 52 to that of an appliance, in this instance in the form of a hydraulic working cylinder 54. Proportional control elements are generally employed to drive the appliance, in this instance in the form of the hydraulic working cylinder 54, even on the basis of the operating comfort desired; exclusively for the sake of greater simplicity of presentation an adjustable throttle 56 is used here in place of the proportional control valves as drive component for the hydraulic working cylinder 54. The appliance volume flow may be varied, and accordingly the working cylinder 54 actuated, by way of the control throttle or control stop 56. The appliance volume flow is determined from the free throttle opening cross-section Q and the pressure difference Δp at the throttle 56 as measured at sensing points 58 upstream and downstream from the throttle 56.

In the load sensing systems in question the valve piston 22 is assigned the function of a kind of piston manometer, the flow regulating piston 28 as part of the control device 26 reducing the volume flow to the appliance 54 independently of load by a constant value in the event of leaks in the hydraulic appliance circuit 62. The difference Δp as measured between the two sensing points 58 is accordingly predetermined by the spring tension of the energy accumulator 24 which engages the piston manometer in the form of the valve piston 22 and is kept constant by adjustment of the piston manometer. Equilibrium then more or less prevails at the valve piston 22 as piston manometer:

$$\Delta p = \frac{\text{spring tension of energy accumulator 24}}{\text{surface area of valve piston 22}} = \text{constant}$$

Consequently, a directly proportional relationship is obtained between the free cross-section Q of the control throttle 56 and the appliance volume flow proper. If an additional force in the form of an additional load in the direction of the appliance circuit 62 is applied to the cylinder rod 64 of the working cylinder 54, the piston manometer in the form of the valve piston 22 is forced into its blocked position as shown in FIG. 2, in which the pump connection 10 is separated from the first tank connection 14 and the fixed displacement pump 52 correspondingly delivers to the piston side 66 of the working cylinder 54 the amount of fluid required to offset the additional load applied. If, however, the working cylinder 54 removes load in the opposite direction, the applied load in question must be offset by a constant load and the fixed-displacement pump 52, which otherwise is secured in the direction of the tank 68 by a pressure control valve 60, now pumps directly by way of the freed connection to the first tank connections 14, the valve piston 22 as piston manometer being retracted in a suitably elevated displacement position in the direction of the appliance connection 18 (see FIG. 1).

If a plurality of appliances is connected to a load sensing system and is supplied by a common fixed-displacement pump 52, the load sensing lines must be linked so that suitable load sensing control of the valve configuration described may be exerted.

If leaks occur in the hydraulic circuit 62 to which the appliance 54 is connected or in the appliance 54 itself, the control device designated as a whole as 26 makes certain that the appliance pressure does not rise undesirably to the pump level, something which would have the result that the load sensing would be disabled. This is prevented by the control device 26, which relieves the load on the appliance connection 18 to the tank 16. The volume flow to the appliance is reduced by a constant value independently of load by the flow regulating device, so that proportional load-independent control is provided. Slowing of the operating process by the appliance 54 with increase in load pressure is reliably prevented. Integration of the flow regulating device into the piston manometer results in a compact structure with a small number of components and the maintenance situation is improved in the case of the valve claimed for the invention.

What is claimed is:

1. A valve with a minimum of one pump connection (10), one tank connection (14), and one appliance connection (18) and with a valve piston (22) positionable inside the valve box (12) which in a minimum of one blocked position separates the pump connection (10) from the tank connection (14) and which operates in conjunction with an energy accumulator (24), a fluid flow being established between the appliance connection (18) and the tank connection (14), the control device (26) consisting of a fluid flow regulator which is integrated into the valve piston (22), and the fluid flow regulator having a flow regulating piston energy accumulator (28) which is longitudinally positionable in the valve piston (22) and rests against another energy accumulator (30), characterized in that the flow regulating piston (28) has a fluid channel (32) which in at least one displaced position of the flow regulating piston (28) discharges into a fluid channel (32) of the valve piston (22), which channel, in at least one displaced position of the valve piston (22), discharges into a separate tank connection (16) in the valve box (12) which is separated from the tank connection (14) connectable to the pump connection (10).

2. The valve as claimed in claim 1, wherein the fluid channel (32) of the flow regulating piston (28) may be closed on its side facing the appliance connection (18) by a control piston (36) which is held in the direction of this closed position by the first energy accumulator (24).

3. The valve as claimed in claim 2, wherein the control piston (36) has as contact component a cup (38) which with its curved end contact surface is provided for fluid conducting insertion into the fluid channel (32) of flow regulating piston (28).

4. The valve as claimed in claim 1, wherein the two energy accumulators (24, 30) are in form of pressure springs and wherein one of the ends of the second energy accumulator (30) rests against the valve piston (22) and the other end of the second energy accumulator (30) rests against the flow regulating piston (28), in such a way that it is introduced into the fluid channel (32) of the flow regulating piston (28).

5. The valve as claimed in claim 2, wherein the separate tank connection (16) is mounted between appliance connection (18) and tank connection (14) in the valve box (12) and wherein the appliance connection (18) discharges into a valve space (48) through which the control piston (36) is extended by the first energy accumulator (24).

6. The valve as claimed in claim 1, wherein the valve piston (22) is provided on its side facing the appliance connection (18) with a stop surface (50).

7. The valve as claimed in claim 1, wherein the valve piston (22) is assigned the function of piston manometer in a load sensing system and wherein the flow regulating piston (28) reduces the volume flow to at least one appliance (54), independent of the load, by a constant value, especially in the event of leakages in the hydraulic appliance circuit (62).

* * * * *